US006397542B1

(12) United States Patent
Flores

(10) Patent No.: US 6,397,542 B1
(45) Date of Patent: Jun. 4, 2002

(54) ADJUSTABLE SCREED

(76) Inventor: Leo Flores, P.O. Box 467, Bonsall, CA (US) 92003

( * ) Notice: Subject to any disclaimer, the term of this patent is extended or adjusted under 35 U.S.C. 154(b) by 0 days.

(21) Appl. No.: 09/779,143

(22) Filed: Feb. 8, 2001

Related U.S. Application Data

(63) Continuation-in-part of application No. 09/723,583, filed on Nov. 27, 2000.

(51) Int. Cl.[7] ..... E04F 13/12

(52) U.S. Cl. ..... 52/365; 52/256; 52/257; 52/288.1; 52/364; 52/371; 52/726.1; 312/140.4; 108/27

(58) Field of Search ..... 52/254, 255, 256, 52/257, 287.1, 288.1, 364, 365, 367, 368, 371, 372, 127.3, 707, 718.01, 718.02, 726.1; 312/140.1, 140.4; 108/27

(56) References Cited

U.S. PATENT DOCUMENTS 3,522,684 A * 8/1970 Grossman ..... 52/393
4,129,971 A * 12/1978 Reusser ..... 52/288.1
5,060,438 A * 10/1991 O'Rourke ..... 52/371
5,348,384 A * 9/1994 Hull et al. ..... 52/287.1 X
5,722,746 A * 3/1998 Hull et al. ..... 52/287.1 X
5,924,253 A * 7/1999 Walker ..... 52/415
5,992,115 A * 11/1999 Felix ..... 52/465

* cited by examiner

*Primary Examiner*—Carl D. Friedman
*Assistant Examiner*—Brian E. Glessner
(74) *Attorney, Agent, or Firm*—Frank G. Morkunas

(57) ABSTRACT

An adjustable screed with a flexible body (suited for use in cut-out areas) or a rigid body (suited for use adjacent to wall-like structures), a horizontal adjustment mechanism for establishing a horizontal plane for the screed and for securely maintaining the horizontal plane, and a vertical stabilizing mechanism for attaching the screed to an external object whereby when one or more screeds are being attached to the external object, the screed is adjusted and aligned to a single horizontal plane, securely maintained at that horizontal plane, and the vertical stabilizing mechanism maintains the attachment of the screed to the external object and maintains vertical stability of the screed as horizontal adjustments are being made.

7 Claims, 3 Drawing Sheets

ADJUSTABLE SCREED

CROSS REFERENCES TO RELATED APPLICATIONS

This application is a continuation-in-part to my pending application, U.S. application Ser. No. 09/723,583, filed on Nov. 27, 2000.

STATEMENT REGARDING FEDERALLY-SPONSORED RESEARCH OR DEVELOPMENT

Not applicable.

BACKGROUND OF THE INVENTION

This present invention relates to an improvement in screeds, and more particularly to screeds which are adjustable and when adjusted to a desired horizontal plane, maintain horizontal and vertical stability when used alone or in conjunction with previously installed perimeter screeds.

A basic screed is a device used to establish an accurate level and flat surface over an existing surface, such as a counter-top, before resurfacing the existing surface with, for example, tiles. Most existing 'flat' surfaces appear to the naked eye to be perfectly flat and horizontal but in fact they generally are not. If tile, such as ceramic tiles or marble tiles and the like, are to be properly laid over the existing surface, that existing surface must be flat-in-fact and horizontal. A screed is a device used to establish a flat and horizontal plane over an existing surface before the tile work is done over that existing surface. The screed basically is a long body (generally made of metal) of any width which, at the tops and bottoms has a perpendicular projecting edge (or rail) running the full length of the metal body. It resembles the letter "E" but without the middle horizontal line with the top and bottom lines shorter. In the body of the screed are numerous large holes and several vertical slots.

Screeds are attached to form a perimeter around an existing surface with the top and bottom edges of the screed facing outward from the existing surface. In this regard, fasteners (typically nails) are snugly placed through the slots and into a counter (which is to be re-surfaced) near the top. The nails attach and hold the screed to the counter yet permit vertical movement of the screed by way of the slot. Taking a typical counter of basically rectangular shape, several screeds are so attached; each relatively independent of one another. Once so attached, a level horizontal plane is to be established. Generally a leveler is used on each screed to set a relatively perfect horizontal plane for the counter top. The tops of all the screeds attached must be aligned exactly with one another into a unitary horizontal plane. This is at least a two-person job. Once this unitary plane is established, the nails in the slots are driven fully into the existing surface to thereby secure the screeds to it. The screeds form a perimeter around the existing surface and above it.

After this is done, an appropriate sub-base in constructed over the existing surface and between the perimeters of the screeds. The last layer, or top, of this sub-base is generally a mortar bed. The mortar generally used is more dry than wet (because wet cement will drip on the floor) and, as a result, must be packed or tamped by the artisan. The large holes in the screed accommodate the flow of mortar into the outside surface of the screed and between the top and bottom edges but also cause sand-like particles to fall out and onto the floor. The top of the sub-base is smoothed using the top edges of the screeds as guides. The sides of the sub-base are formed between the top and bottom edges of the screed and they are smoothed out using the far outer ends of the top and bottom edges and guides. If the screeds were properly aligned and adjusted, after the sub-base is finished, the counter now has a virtually horizontal level flat top new surface upon which tiles may be more easily installed and display an even flat surface upon completion.

Needless to say, the process is cumbersome, tedious, and difficult. The labor is manual and intense. The screeds, as installed, do not have any vertical stability. The horizontal stability is limited to a driven nail or nails into a slot. In this working environment, much physical movement takes place. An accidental touching of the screed from the top could dislodge the horizontal alignment so painstakingly obtained. Minor movements may not even be noticed. The mortar bed of the sub-base is dense and heavy. It is placed within the perimeter formed by the screeds around the existing surface. Its sheer volume, weight, and tamping could displace the perpendicular arrangement of the screed to the horizontal plane. This displacement could be slight or extensive. If slight, it may go unnoticed, if extensive, further adjustments of one or more screeds must be made and maintained. This, at a time, when the sub-base is nearly complete, renders the task all the more difficult. Prior art screeds are also not suited to establish a suitable sub-base at or near walls or at or near cut-out areas (such as a cut-out for a sink. in a kitchen or bathroom). Currently, the artisan uses the perimeter screeds already attached and, for wall areas, 'eye-balls' the leveling and, for cut-outs, generally builds a mortar mound adjacent to the perimeter of the cut-out. None of the methods are exact for good leveling needs.

The prior art has adjusters and stabilizers of all sorts. None is as versatile or as easy to use to make the job more efficient and the result more professional. The present invention is a vast improvement over existing screeds and the improvements and enhancements of the past. It provides for a simplification to the process of establishing a true unitary horizontal plane, provides for the maintaining of that horizontal place without dislodgement therefrom, provides for vertical stability, and further provides for a means to use screeds at, on, or near walls or wall-like structures, and for internal cutout areas in the objected to be covered/re-tiled.

The objects of the present invention are to:

a. make it easier to horizontally level an existing surface before applying a new surface thereon;
b. provide for an easy-to-use and easy-to-adjust screed assembly which maintains a horizontal and vertical plane;
c. provide a screed for used at or near a wall or wall-like structure;
d. provide a flexible adjustable screed for use within internal structures, such as cut-out areas; and
e. make it easier to establish and maintain a unitary horizontal plane and to more cleanly apply cement thereto.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF SUMMARY OF THE INVENTION

The above-noted problems, among others, are overcome by the present invention. Briefly stated, the present invention contemplates an adjustable screed with a body, a horizontal adjustment mechanism for establishing a horizontal plane for the screed and for securely maintaining the horizontal plane, and a vertical stabilizing mechanism for attaching the screed to an external object whereby when one or more screeds are being attached to the external object, the screed is adjusted and aligned to a single horizontal plane, securely maintained at that horizontal plane, and the vertical stabilizing mechanism maintains the attachment of the screed to the external object and maintains vertical stability of the screed as horizontal adjustments are being made. The screed may be flexible, in which case it generally has no top rail or bottom rail and is suited for use in cut-out areas; or it may be rigid, in which case it has a top rail and is suited for use adjacent to wall-like structure.

The foregoing has outlined the more pertinent and important features of the present invention in order that the detailed description of the invention that follows may be better understood so the present contributions to the art may be more fully appreciated. Additional features of the present invention will be described hereinafter which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

For a fuller understanding of the nature and objects of the invention, reference should be had to the following detailed description taken in conjunction with the accompanying drawings in which.

DETAILED DESCRIPTION OF THE INVENTION

Figure 1:
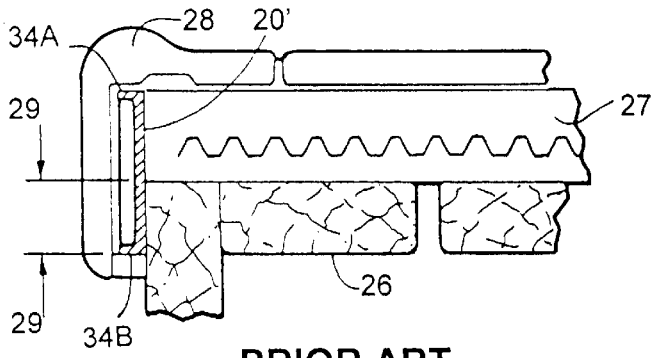
PRIOR ART FIG. 1
FIG. 1 is cross-section view of a conventional prior art screed application on an existing surface.
Figure 2:
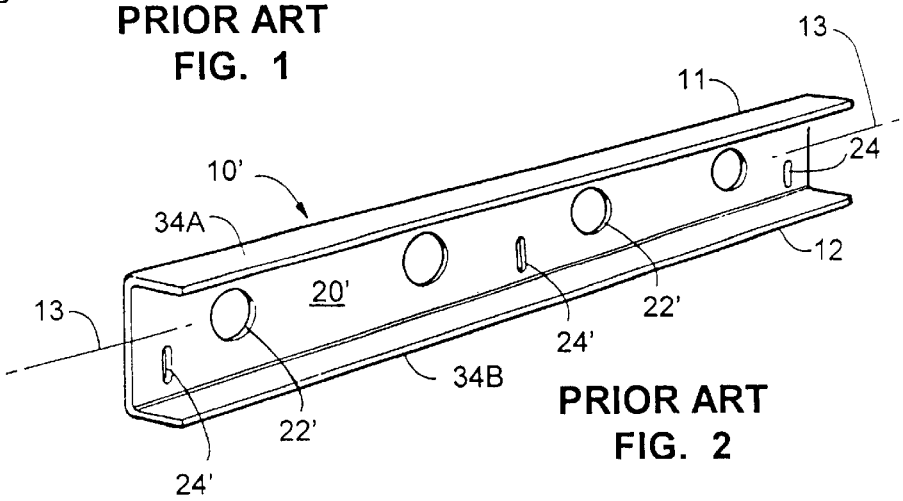
PRIOR ART FIG. 2
Fig 2 represents a prior art screed.

Prior art application of screeds on existing surfaces is illustrated in FIG. 1. FIG. 2 depicts a prior art screed 10'. It has a rigid body 20', a top rail 34A, a bottom rail 34B, one or more channels 24', and one or more large holds 22'. The channels 24' are generally below a centerline 13 and are used to attach the screed 10' to an external object. In FIG. 1, the body 20' of the screed 10' is shown to be attached to an external object (a counter {or sub-top} 26 for example) with the top edge (or rail) 34A and the bottom edge (or rail) 34B, each on the outer surface 12 and extending away from the body 20', facing away from the counter 26. Note the bottom rail 34B sits below the top plane of the counter 26 while the top rail 34A projects well above. The distance from the top of the counter 26 to the top edge generally should be sufficient to accommodate a sufficient amount of mortar, or its equivalent, to create a new top surface 27 (or mortar bed) which can be leveled to a relatively accurate horizontal plane and be smoothed flat. The inner surface 11 of the prior art screed 10' abuts the external object. A sufficient number of screeds 10' are attached to the external object to create a border or screed perimeter around the external object.

Large holes 22' accommodate the flow of mortar to create a side edge of mortar (for a mortared side) and to provide a means to retain the mortar therein by having an unbroken mortar link between the top surface and the side-surfaces. The distance is dependent upon the height of the screed body 20 naturally, the desired depth of the new top surface 27, and the type of new covering 28 to be used. On typical counter tops, a sub-top depth of between one-quarter inch to one-and-one-half inch is suitable. Most typically, a three-quarter inch depth is used. It is upon this new top surface 27 that the new cover 28 (such as, but not limited to, ceramic tiles, marble tiles, composite tiles, and the like) is cemented and placed. A screed is then secured to the counter 26, generally at the 'meatiest' section 29 (that section where the counter top and its side meet and where nearly any length nail or screw may be driven to its full length).

As earlier explained, current screeds are difficult to use, difficult to align, difficult to establish and maintain a unitary horizontal plane, and difficult to establish and maintain secure vertical stability while the counter 26 is being re-covered. They also are not suited at all for cut-out areas nor are they well-suited for use adjacent to walls. These difficulties and obstacles have been overcome by the present invention.

Figure 4:
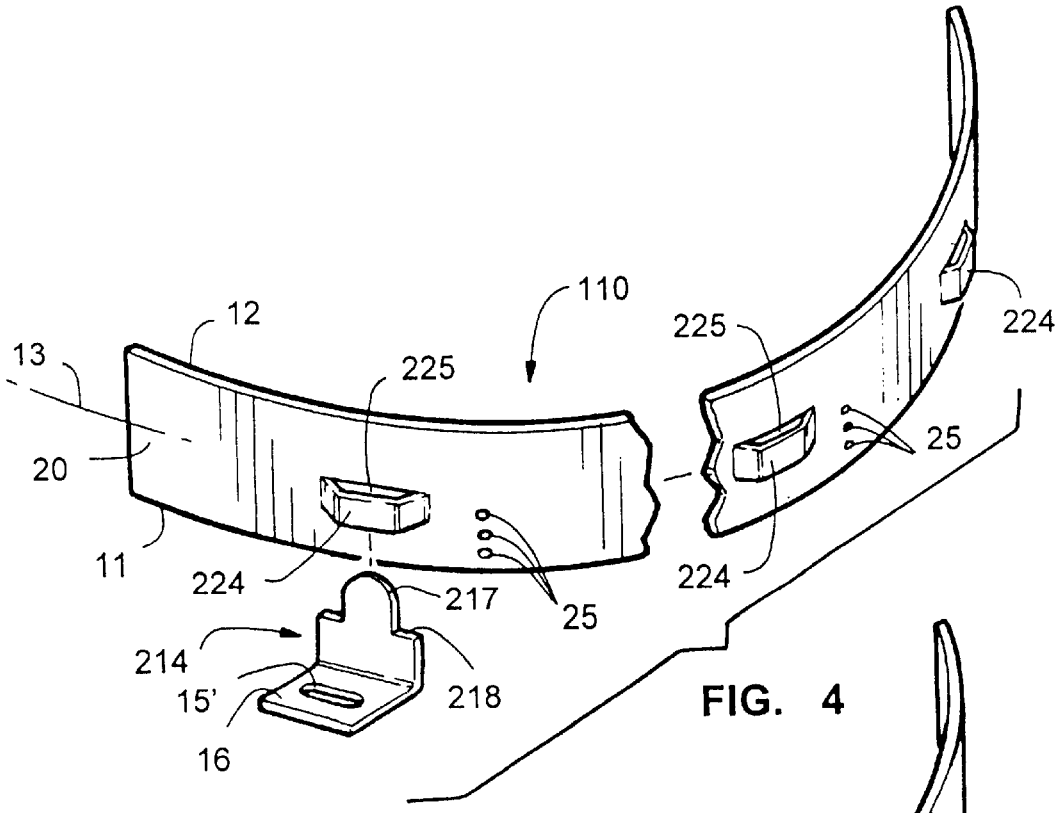
FIG. 4 is a perspective view of the improved screed assembly of FIG. 3 having different horizontal adjustment elements.
Figure 3:
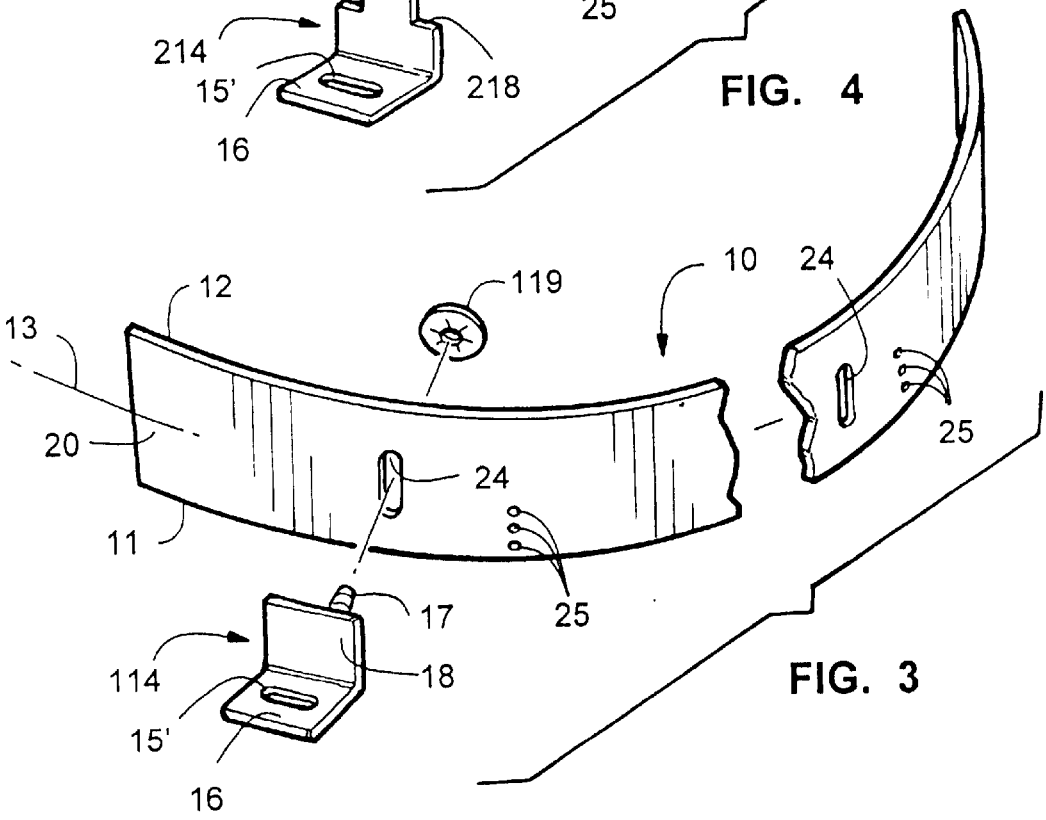
FIG. 3 is a perspective partial view of one embodiment of the improved screed assembly.

Referring now to the drawings embodying the present invention, and in particular to FIGS. 3 and 4, reference characters 10, 110 generally designate an adjustable screed with a flexible body 20 constructed in accordance with a preferred embodiment of the present invention. The difference between the two being the horizontal adjustment mechanism to be described later. The body 20, like a screed of prior art, is generally an elongated strip having an inner surface 11 and an outer surface 12. Unlike the screeds of my previously-filed application, mentioned above, and unlike prior art screeds, the flexible screeds have no top rail or bottom rail and are well-suited to screed-up a cut-out area within a previously formed screed perimeter and aligned to that perimeter.

The second embodiment screed 210 of the present invention (FIG. 5) has only a top rail 30 and, like the prior art screeds 10', the top rail 30 may be approximately perpendicular to the body 20 and projecting away from the body 20; or may, but need not, be angled slightly downward to provide support for mortar placed therein. This embodiment screed 220 is a rigid screed and is adapted to abut a wall or wall-like structure, adjusted or registered to a previously formed screed perimeter and aligned to that perimeter. Note, also, that large holes 22 are not required for either of my new screeds 10, 110, 210.

Referring now to FIG. 3, near the top are one or more channels 24.. These channels 24, in conjunction with either 20 bracket member 14, 114, or 114' (these bracket members are illustrated in FIGS. 6–9 and are fully described below), function to establish a horizontal plane co-equal with a previously established screed perimeter horizontal plane preferably using screeds as described in my prior application, U.S. application Ser. No. 09/723,583 (which, for reference purposes, is hereby incorporated herein). The horizontal plane for the flexible screed assemblies is established using the previously established horizontal plane formed by the screed perimeter as a guide.

Bracket member 14 (FIG. 6) has a base 16 and a wall 18 which is approximately perpendicular to the base 16. A pin or shaft 17 extends outward from the wall 18. A retaining member 19 is attached to the shaft 17. The retaining member 19 generally can be a bar or strip or any suitable configuration suited for the intended purpose of permitting insertion of the bracket member 14 into the channel 24 and retaining the bracket member 14 thereat. In this regard, the retaining member 19 of this embodiment generally should be approximately parallel with the base 16 and extend outward toward each side of the wall 18. It should be of sufficient length to permit its access into and through the channels 24. The distance between the retaining member 19 and the wall 18 is sufficient to permit movement within the channels 24 when inserted therein but should also be such as to make the fit within the channels 'snug'.

As so constructed, by rotating the retaining member 19 about 90° along the axis of the shaft 17 the retaining member 19 then could be fitted through the channel 24 up to the shaft 17 to thereby permit the opposite end of the retaining member 19 to be placed through the channel 24 such that the wall 18 rests against the body 20. The retaining member 19 would then be rotated back to its original position. The fit is snug to permit an up-down translation (horizontal alignment) yet also to maintain any updown position into which translated.

The bracket member 14 also has an aperture 15 in the base 16 to accommodate a fastener therethrough. The aperture 15 may be or any size and any configuration (See FIG. 11 for an elongated oval-like aperture 15' which accommodates slight lateral movement of the bracket member 14 as the screeds are being horizontally adjusted). Any suitable fastener will suffice, such as, but not limited to, nails, screws, staples, tacks, and the like. Using a nail is most common. Once the bracket member 14 is placed into the channels 24, the base 16 is placed on top of the existing surface and a nail would be driven into the existing surface through the aperture 15. This attaches the screed assembly 10 to the existing surface and also provides vertical stability to the screed assembly 10 while an artisan then makes horizontal adjustments and alignments with other perimeter screeds. Once a true unitary horizontal is established with the other perimeter screeds, the screed assembly 10 is secured to-the existing surface by way of one or more sets of one or more vertically disposed apertures 25 near the bottom, or below the center line 13, of the body 20 through which generally one suitable fastener (such as a nail) per set may be driven.

It must be understood that the channels 24 may be near the top or may be near the bottom and that the bracket member 14 may insert into the channels 24 with the base 16 up (proximal to the top or with the base 16 down and proximal to the bottom). How they insert will relate to the location of the channels 24, the desired depth of the sub-base 27, and the upper plane of the previously formed screed perimeter.

Figure 7:
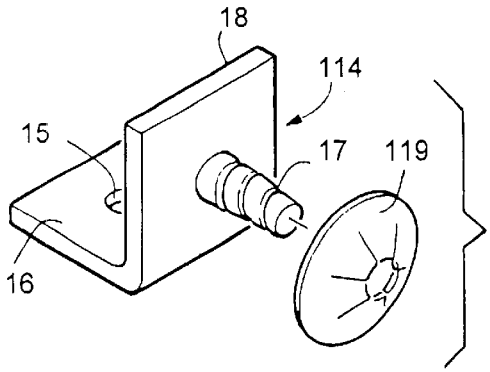
FIGS. 6–11 are detailed views of several embodiments of the bracket member.
Figure 6:
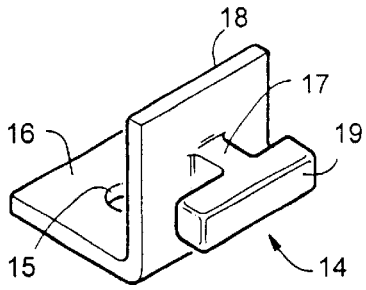
Figure 8:
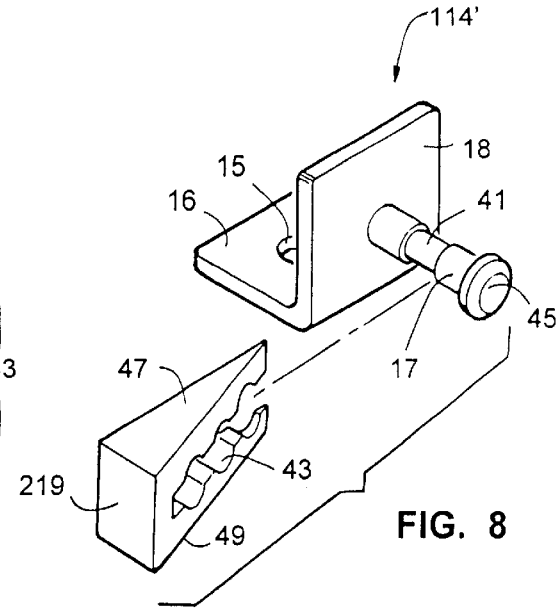

Another embodiment of the bracket member 114 briefly mentioned earlier for use with this screed assembly 10 is illustrated in FIG. 7. This bracket member 114 shares the same features of the previously described bracket member 14 except that the retaining member 119 is removable from the shaft 17. This bracket member 114 inserts more easily into the channel 24 and, once inserted, the retaining member 119 is pressed or screwed or otherwise secured onto the shaft 17 to more firmly maintain the bracket member 114 in the channel 24 while still permitting vertical translation therein. Any suitable retaining member 119 suited for the intended purpose will suffice including, but not limited to, grommets, rubber washers or bushings, push-pins, locking or webbed washers, cotter-pins, and nuts. The shaft 17 may be rounded, oval, triangular, squared, tapered, threaded, smoothed, roughened, have a hole transversing the shaft, a slit (as illustrated in FIG. 8, reference character 41 to be described later), and the like, or any combination thereof. The retaining member 119 must snugly or tightly retain the bracket member 114 within the channel 24 yet permit vertical movement of the shaft 17 through the channel 24 or, conversely, vertical movement of the attached screed through the shaft to thereby permit horizontal alignment of the screed assembly 10.

Figure 9:
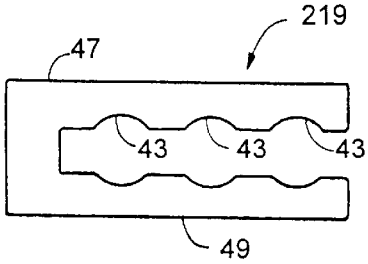

FIGS. 8 and 9 illustrate yet another embodiment bracket member 114'. This bracket member 114' is very similar to that which was described above and illustrated in FIG. 7 except that the shaft 17 has a slot 41 around the shaft 17 and a blunt or mushroom-like end 45. This bracket member 114' inserts through the channel 24 but then a-wedge-like retaining member (or clip) 219 is pressed into and seated over the shaft 17. As the wedge-like retaining member 219 is pushed over the shaft 17, because it is wedge-like, the farther it is pushed over the shaft 17, the more is presses against the mushroom-like end 45 and against the wall screed body 20 and the wall 18 of the bracket member 114'. The more it is pushed in, the greater its hold. FIG. 9 is a detailed illustration of the wedge-like retaining member 219. It has a cut-out between the top 47 and the bottom 49. There are one or more grooves 43 on the upper and lower surfaces of the cut-out. In operation, the cut-out of the wedge-like retaining member 219 is placed over the shaft 17 and is pushed over the shaft 17 until one of the grooves 43 securingly mates with the slot 41 on the shaft 17 and one side of the wedge-like retaining member is also firmly pressed against the mushroom-like end 45 and the other side of the wedge-like retaining member is firmly pressed against the screed body 20 (and indirectly, against the wall 18 of this bracket member 114'. Once the mortar bed has been laid, leveled, and set, the shafts and retainers of bracket members 14, 114, 114' may be cut and/or otherwise removed.

Figure 5:
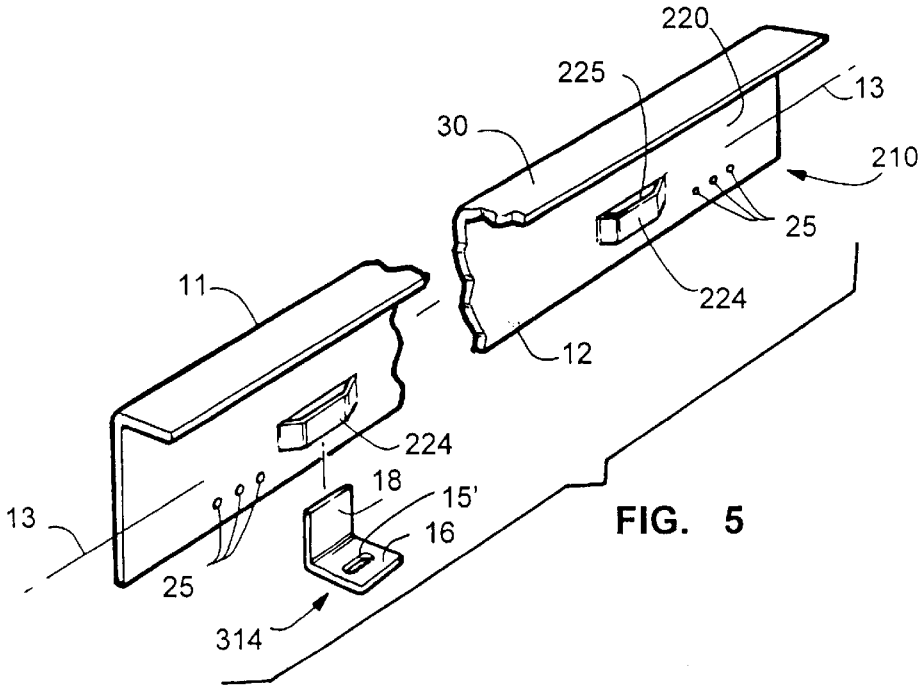
FIG. 5 is a perspective view of another embodiment of the improved screed assembly.

Another embodiment of the horizontal adjustment mechanism is illustrated in FIG. 4 (for the flexible screed assembly 110) and in FIG. 5 (for the rigid screed assembly 210). Each screed assembly has an inner surface 11, an outer surface 12, and one or more sets of one or more apertures 25 in the body for securing either screed assembly 110, 210 to an external object. The main differences here lie in the aperture sets 25 (vertically disposed for the flexible screed assembly 110 and horizontally disposed for the rigid screed assembly 210), in the horizontal adjustment mechanism's projecting strips 224 on the respective bodies 20, 220 (extended from the inner surface 11 of flexible screed 110, extended from the outer surface 12 of rigid screed 210), and the addition of a top rail 30 for the rigid screed 210. The top rail 30 facilitates leveling of the mortar bed when used in conjunction with the tops of the previously set perimeter screeds.

Figure 11:
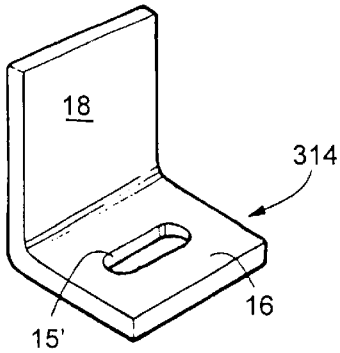
Figure 10:
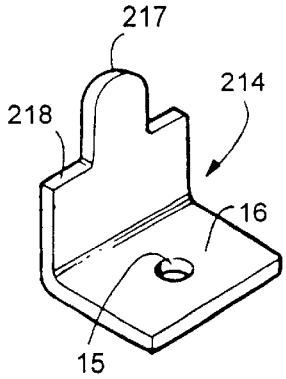

As for the projecting strips 224 of either screed assembly 110, 210, they generally are two parallel cuts, generally situated above the center-line 13 of the body 20, 220, which are parallel to the top and, as in the embodiment depicted in FIG. 4, are pushed out of the body 20 from the outer surface 12 leaving a space 225 in the projecting strip 224 on the inner surface 11 to accommodate the projection 217 or wall 18 of the bracket members 214, 314, respectively, which are depicted in FIGS. 10 and 11. This inner area of the space 225 which accepts the projection 217 (FIG. 10) or the wall 18 (FIG. 11) also may be a roughened area, may be corrugated, may be dimpled, or may be wavy, and the like, or any combination thereof, to better hold the projection 217, or wall 18 as the case may be.

These bracket members 214, 314 are much like the previously described bracket member 14 with base 16, wall 18 approximately perpendicular to the base 16, and aperture 15 in the base 16. The main difference is that these bracket members 214, 314 have no shaft 17 or retaining member 19, 119. Instead bracket member 214 has a projection or tab 217 extending above the wall 18, and not as wide as the wall 18, which inserts tightly into the space 225 so that either screed assembly 110, 210 when attached to an external surface by this bracket member 214, will maintain its horizontal position. Though the fit of the projection 217 into the space 225 is relatively tight (with little tolerance) to maintain the horizontal position, it is not so tight that this bracket member 214, upon application of some degree of force, cannot translate vertically within the space 225, to ride on the projection 217 up until the top (or shoulder) 218 of the wall 18 strikes the bottom of the projecting strip 224 and prevents further movement in that direction or to bring it down depending on what is required for obtaining a horizontal plane.

The bracket member 314 depicted in FIG. 11 is similar to the previously described bracket member 214 except that it does not have a projection (217). Instead, the wall 18 of this bracket member 314 is taller extending upward to a height about equal in height as the wall 18 plus projection 217 of bracket member 214. Note the aperture 15' in the base 16 is elongated. The aperture 15' may be elongated in a side-to-side relation to the base 16, in a front-to-rear relation to the base 16, or diagonally. The side-to-side or diagonal elongation of the aperture 15' fosters lateral translation when the assembly is being horizontally adjusted—which may be significant, and required, depending on the degree of adjustment necessary. It must be understood that either type aperture 15, 15' may be on any type of bracket member previously described 14, 114, 114', 214, 314 and such are not to be limited to the aperture illustrated in any specific figure.

With either screed assembly 10, 110, 210 the positioning of the horizontal adjustment mechanisms on the body 20, 220 is important-in that such positioning is what will accord the artisan the ability to establish a horizontal plane co-equal to the horizontal plane established by a previously created screed perimeter. The mortar bed 27, or equivalent, should be of sufficient depth necessary to establish the new top surface necessary to accommodate the new covering to be placed over it. As was stated earlier, this depth could range from about one-quarter (0.250) inch to about one and one-half inches (with three-quarter (0.750) inch being better). Screeds vary in width of the body 20, 220 (i.e., from top to bottom) and vary in length (length can and generally is cut to suit the project). To better explain positioning, a screed having a body width of one and three-quarter (1.750) inches will be used as example only, not by way of limitation, so that ratios can be established. Using this example screed, the centerline 13 would be one-half the width, or seven-eighths (0.875) of an inch. To permit a suitable translation of a screed 10 having a channel 24. The channel 24 should begin above the centerline 13 by about 0.0625 inches and be about 0.625 inches long. With these dimensions as ratios the length or height of the wall 18, from bottom of base 16 and up, or down (as the case may be, the wall 18, should be about 0.690 inches and the axis of the shaft 17 should be about 0.500 inches from the bottom of the base 16. This will provide a good position for the bracket member 14 to rest on the external object in relation to the screed assembly 10 it will support and will also provide a sufficient ride or vertical translation to set a proper depth (up to a maximum of 0.750 inches in this example) for the mortar bed to be applied within the perimeter established.

With regard to dimensions for the second embodiment screed assemblies utilizing protruding strips 224, I will use the same dimensions as above for the body 20, 220 width as a point of relative reference. In this regard the top cut of the projecting strip is about 0.500 inches from the top and the bottom cut about 0.250 inches below the top cut. The bottom cut in this example is above the centerline 13. The full height of bracket member 214 for these screed assemblies 110, 210 is about 0.750 inches, the height from the bottom of the base 16 to the shoulder 218 is about 0.500 inches and the height of the projection 217 on the wall at about 0.250 inches (for bracket member 314, the overall dimensions are basically the same; i.e., the height of the wall 18 will be equal in height to the combined height of the shoulder 218 plus the projection 217). This permits a good vertical translation so that an accurate horizontal plane with the screed perimeter can be obtained. In these examples, the bracket member 214, 314 is used with the base 16 distal from the top.

It must be understood that as the body 20, 220 width increases or decreases in dimension, proportional increases in positions and dimensions are or may be respectively increased or decreased accordingly. In some cases, although the body 20, 220 width increases or decreases, the depth of the mortar bed remains constant with the example screed described above; i.e., about 0.750 inches.

The location of the vertically disposed apertures 25 on either embodiment of the flexible screed 10, 110 will be the same. Generally the location on the body 20 should be below the centerline 13 but that may not always be the case-as the user may desire a long side border of the perimeter which would then require a flexible screed to have a long body width. The meatiest section 29 of the external object might then be above the centerline 13. Though the location could be below the centerline 13 and/or at or near the bottom, the best location is within the vicinity of the meatiest section 29. With the example screed as defined above, and with typical counter-top installations, the best location is below the centerline 13 with the center of the bottom aperture being about 0.3125 inches above the bottom, the next aperture center about 0.1875 above the bottom aperture center, and the top aperture about 0.1875 above the center of the center aperture.

The location of the horizontally disposed apertures 25 of the rigid-like screed 210, also should generally be below the centerline 13; but need not. Since it is best to drive the nail into the meatiest section of the wall (i.e., where the stud is located) and since through various adjustments, were there only one such aperture, the nail could miss the stud and provide little or no support, more than one such aperture is provided per set with each set generally spaced about 16 inches apart from the previous set. Sixteen inches is appropriate under current building standards for studs; but, the key here is that spacing should generally mirror or reflect the spacing of the respective studs involved. In the embodiments illustrated, I have found that three apertures per set, spaced horizontally apart between about one-eighth of an inch to about three-eighths on an inch apart will accommodate this requirement. Best spacing is about three-sixteenth of an inch apart. Since the artisan is seeking a stud into which to place a suitable fastener through one or more of these apertures, height location for the set of apertures is not important as it is for the flexible screed embodiments 10, 110.

The present disclosure includes that contained in the present claims as well as that of the foregoing description. Although this invention has been described in its preferred forms with a certain degree of particularity, it is understood that the present disclosure of the preferred forms has been made only by way of example and numerous changes in the details of construction and combination and arrangement of parts may be resorted to without departing from the spirit and scope of the invention. Accordingly, the scope of the invention should be determined not by the embodiments illustrated, but by the appended claims and their legal equivalents.

The invention claimed is:

1. An adjustable screed comprising:

a body having a vertical front side and a vertical back side with a top rail extending outward in the direction of said back side;

horizontal adjustment means for establishing a horizontal plane for the screed and for securely maintaining the horizontal plane, wherein said horizontal adjustment means comprises a horizontal projection on said back side extending outward in the direction of said back side, said projection having a slit on its top and its bottom, and a bracket member, said bracket member having a flat base and an upstanding wall from said base wherein said wall is adapted to securingly insert into said projection from said back side through the bottom slit and through the top slit of said projection to thereby permit horizontal adjustment of the screed and to securely maintain said bracket member in an adjusted desired position in said projection; and vertical stabilizing means for attaching the screed to an external object;

whereby when one or more screeds are being attached to the external object, the screed is adjusted and aligned to a single horizontal plane, securely maintained at that horizontal plane, and said vertical stabilizing means maintain the attachment to the external object and maintain vertical stability of the screed as horizontal adjustments are being made.

2. The screed as claimed in claim 1 wherein said vertical stabilizing means comprises an aperture in said base of said bracket member, wherein said bracket member is attached to the external object by a suitable fastener driven through said aperture and into the external object.

3. The screed as claimed in claim 1 further comprising securing means for securing the screed to the external object.

4. The screed as claimed in claim 3 wherein said securing means comprises one or more sets of apertures on said body, each of said one or more sets of apertures comprising one or more horizontally disposed apertures.

5. An adjustable screed comprising:

a substantially flexible and bendable flat body having a vertical front side and a vertical back side;

horizontal adjustment means for establishing a horizontal plane for the screed and for securely maintaining the horizontal plane, wherein said horizontal adjustment means comprises a horizontal projection on said back side extending outward in the direction of said back side, said projection having a slit on its top and its bottom, and a bracket member, said bracket-member having a flat base and an upstanding wall from said base wherein said wall is adapted to securingly insert into said projection from said back side through the bottom slit and through the top slit of said projection to thereby permit horizontal adjustment of the screed and to securely maintain said bracket member in an adjusted desired position in said projection; and vertical stabilizing means for attaching the screed to an external object;

whereby when one or more screeds are being attached to the external object, the screed is adjusted and aligned to a single horizontal plane, securely maintained at that horizontal plane, and said-vertical stabilizing means maintain the attachment to the external object and maintain vertical stability of the screed as horizontal adjustments are being made.

6. The screed as claimed in claim 5 further comprising securing means for securing the screed to the external object.

7. The screed as claimed in claim 6 wherein said securing means comprises one or more sets of apertures on said body, each of said one or more sets of apertures comprising one or more vertically disposed apertures.

* * * * *